US006042446A

United States Patent [19]

Louis

[11] Patent Number: 6,042,446

[45] Date of Patent: Mar. 28, 2000

[54] PERKING TURKEY PADDLE

[76] Inventor: Wilner Louis, 1715 W. 158th St., Gardena, Calif. 90242

[21] Appl. No.: 08/999,385

[22] Filed: Dec. 22, 1997

[51] Int. Cl.[7] ..... A63H 29/08

[52] U.S. Cl. ..... 446/170; 446/330; 446/359

[58] Field of Search ..... 446/169, 170, 446/322, 326, 330, 336, 351, 357, 359, 360, 325, 417, 421

[56] References Cited

U.S. PATENT DOCUMENTS

| | | | |
|---|---|---|---|
| 1,506,126 | 8/1924 | Kuenz | 446/351 |
| 2,059,447 | 11/1936 | Ekberg | 446/351 |
| 2,834,151 | 5/1958 | Zobrist | 446/169 |
| 3,202,426 | 8/1965 | Carper | 446/170 |

*Primary Examiner*—Robert A. Hafer
*Assistant Examiner*—Jeffrey D. Carlson
*Attorney, Agent, or Firm*—Norton R. Townsley

[57] ABSTRACT

A pecking bird toy comprising: a hollow paddle portion, a pecking bird portion and a ball. The hollow paddle portion has a handle and an interior circular raceway. The pecking bird portion is mounted on the top of the hollow handle portion. The pecking bird portion includes a fixed body with a cavity in its lower portion, a head and neck part and a mechanism which imparts a pecking motion to the head and neck part. The head and neck part is pivotally mounted within the cavity. The mechanism is pivotally attached to the end of the head and neck part and includes an actuating pin, with a shallow or truss head, extending through the top of the hollow handle portion into the raceway. The ball is trapped within the raceway as the hollow handle portion is assembled. The invention is designed so that the raceway has a width slightly larger than the diameter of the ball and the distance between the head and the bottom of the raceway is less than the diameter of the ball. The head of the actuating pin can be designed so that the ball can lift the actuating pin from either direction or from one direction only.

9 Claims, 6 Drawing Sheets

PERKING TURKEY PADDLE

BACKGROUND OF THE INVENTION

The present invention relates to the field of toys and more particularly to toys that simulate pecking birds.

Zobrist, in U.S. Pat. No. 2,2834,151 describes a pecking bird toy which is actuated by a ball falling under the influence of gravity through a ladder-like device. Kuenz in U.S. Pat. No. 1,506,126 describes a paddle shaped toy having pecking birds on its top surface which is actuated by swinging a counter weight. Kuenz' toy is difficult and possibly hazardous for small children to play with. Zobrist's toy is not based on a paddle and requires little skill to manipulate.

Development of a pecking bird toy which can be manipulated with a modicum of skill and yet be non-hazardous for small children represents a great improvement in the field of toys and satisfies a long felt need of parents and small children.

SUMMARY OF THE INVENTION

The present invention is a pecking bird toy comprising: a hollow paddle portion, a pecking bird portion and a ball. The hollow paddle portion has a handle and an interior circular raceway. The pecking bird portion is mounted on the top of the hollow paddle. The pecking bird portion includes a body with a cavity in its lower portion, a head and neck part, and a mechanism which imparts a pecking motion to the head and neck part. The head and neck is pivotally mounted within the cavity. The mechanism is pivotally attached to the end of the head and neck part and includes an actuating pin, with a shallow head, extending through the top of the hollow handle portion into the raceway. The ball is trapped within the raceway as the hollow handle portion is assembled. The invention is designed so that the raceway has a width slightly larger than the diameter of the ball and the distance between the head and the bottom of the raceway is less than the diameter of the ball.

When the hollow paddle portion is tilted via the handle, the ball can be caused to circulate around the raceway causing the actuating pin to be periodically lifted. As the ball moves on, the actuating pin immediately falls under the influence of gravity. In consequence, the mechanism causes the pivoting head and neck part to simulate a pecking motion.

The head of the actuating pin is usually designed as a truss head. Thus the ball can lift the actuating pin whether it circulates in a clockwise or counterclockwise direction. Alternatively, one side of the head can be truncated which will allow the ball to lift the actuating pin from one direction only.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

Figure 1C:
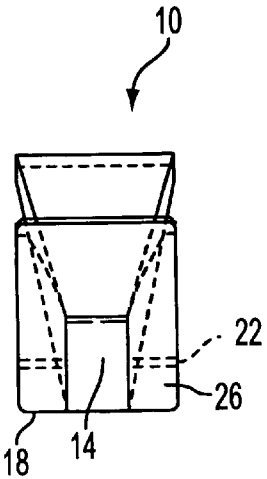
FIG. 1C is a front view of the bird body of this invention.
Figure 1B:
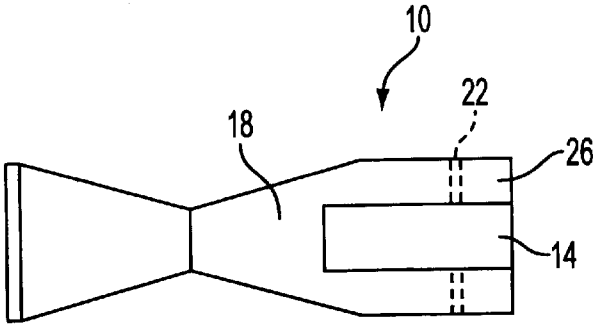
FIG. 1B is a bottom of view of the bird body of this invention.
Figure 1A:
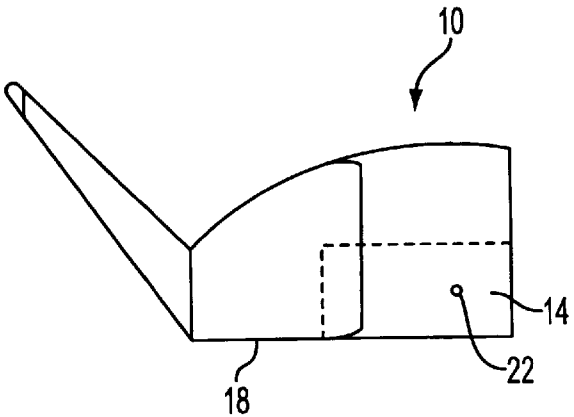
FIG. 1A is a side view of the bird body of this invention.
Figure 9:
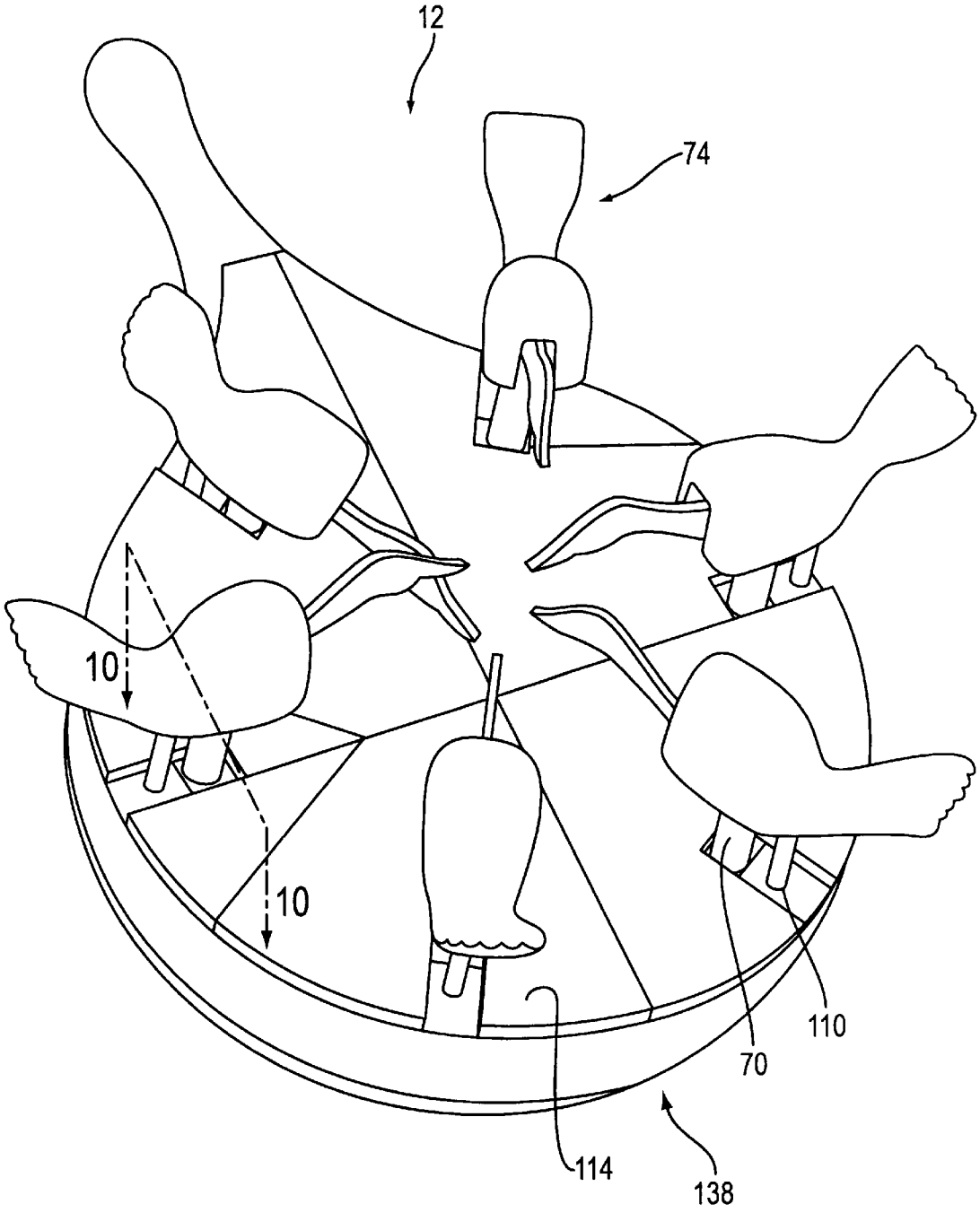
FIG. 9 is a three-dimensional view of the fully assembled invention.
Figure 10:
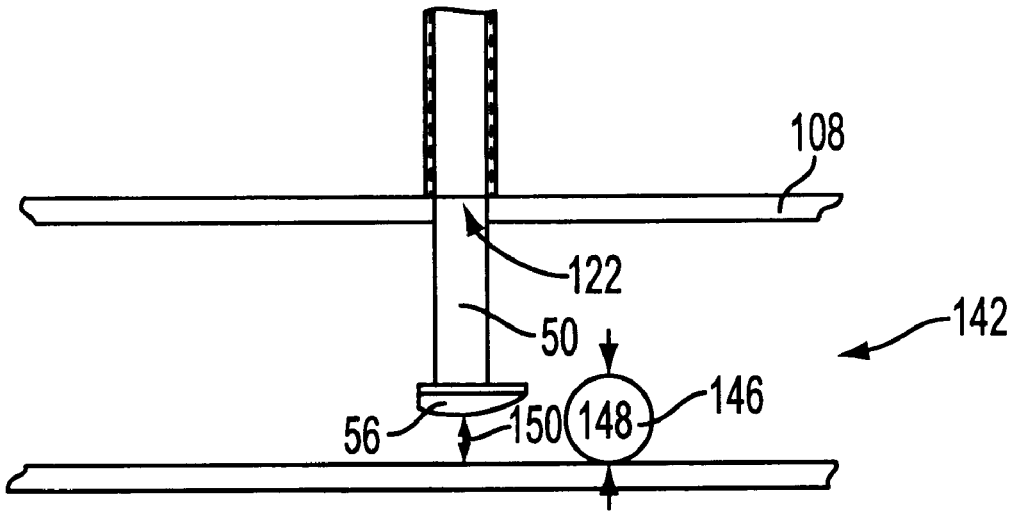
FIG. 10 is a partial cross-sectional view along the curved line 10—10 of FIG. 9.

This invention 12 comprises three main parts: a pecking bird 74 (see FIGS. 1–5), a hollow paddle 138 (See FIGS. 6–9) and a ball 146 (see FIG. 10). FIGS. 1A through 1C illustrate the bird body 10 of this invention 12. As shown on these Figures, the body 10 has a rectangular cavity 14 extending part way through it and open to the bottom 18. Holes 22 for accepting a pivot pin traverse the fingers 26 which remain on each side of the cavity 14. In these Figures, the bird body 10 is made to resemble a turkey.

Figure 2:
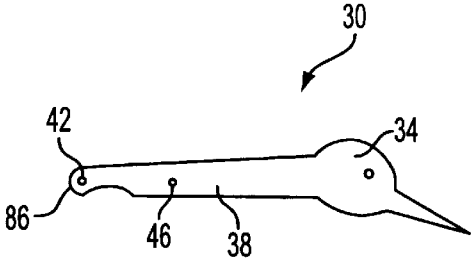
FIG. 2 is a side view of the bird neck of this invention.

FIG. 2 is a side view of the head and neck part 30 of this invention 12. The head and neck part 30 has said a stylized bird head 34 attached to an elongated arm 38. The arm 38 has several pivot holes, a first one 42 almost at the end 86 and a second one 46 part way along its length.

Figures 3A, 3B:
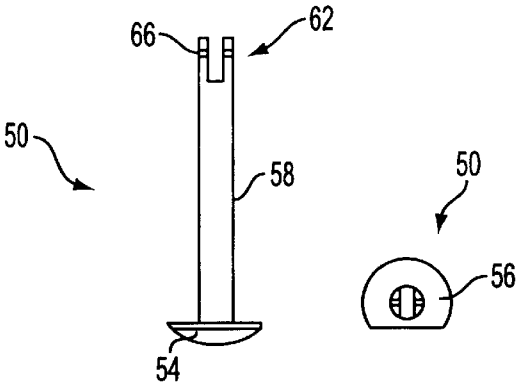
FIG. 3A is a side view of the actuating pin of this invention.
FIG. 3B is a top view of the actuating pin of this invention. This view illustrates an alternate, truncated head version of the actuating pin.

FIG. 3A is a side view of the actuating pin 50 of this invention 12. The actuating pin 50 has a shallow curved head 54 and a shank 58 with a clevis 62 at one end. A pivot hole 66 traverses the clevis 62.

FIG. 3B is a top view of the actuating pin 50 of this invention 12. This view illustrates an alternate, truncated head 56 version of the actuating pin 50.

Figures 4A, 4B:
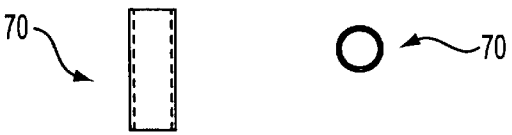
FIG. 4A is a side view of the sleeve of this invention.
FIG. 4B is a top view of the sleeve of this invention.

FIGS. 4A and 4B illustrate the sleeve 70 of this invention 12. The sleeve 70 is essentially a short piece of tubing.

Figure 5:
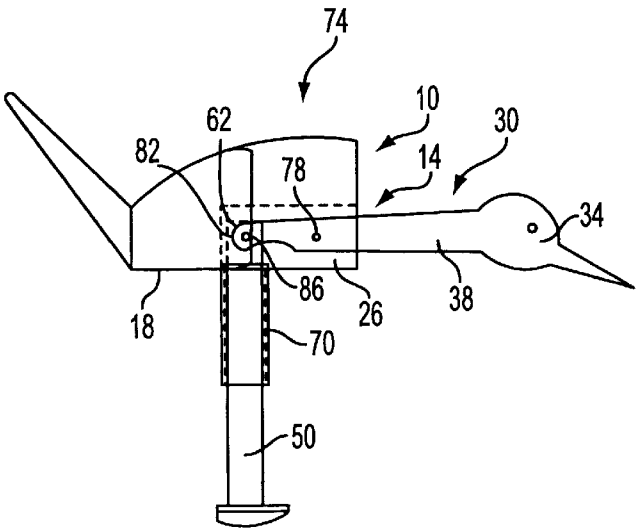
FIG. 5 is a side view of the assembled pecking bird of this invention.

FIG. 5 is a side view of the assembled pecking bird 74 of this invention 12. The sleeve 70 is attached to the bottom 18 of the body 10. The head and neck part 30 is inserted into the cavity 14 where it is attached by a first pivot pin 78 inserted through the second hole 46 in the elongated arm 38 and the holes 22 through fingers 26 of the body 10. The actuating pin 50 is inserted through the sleeve 70 and the clevis 62 is attached to the end 82 of the elongated arm 38 by second pivot pin 86. It will be obvious that the bird's head 34 will pivot down as the actuating pin S0 is pushed up and then will elevate as the actuating pin 50 falls back down under the influence of gravity. By well known principles of physics, the mechanism 30, 50, 78, 86 that causes the bird 74 to peck is adjusted so that small movements in the actuating pin 50 cause large movements in the head 34.

Figure 6A:
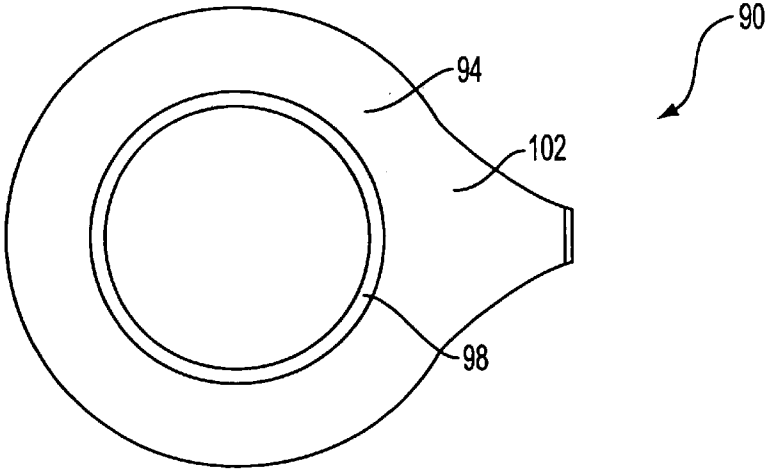
FIG. 6A is a top view of the bottom section of the paddle portion of this invention.
Figure 6B:
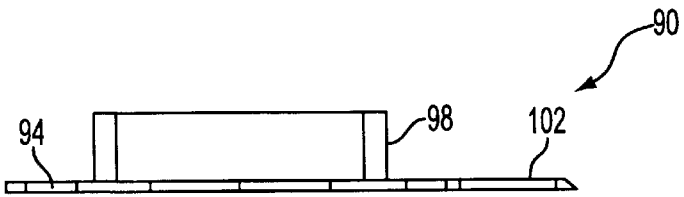
FIG. 6B is a side view of the bottom section of the paddle portion of this invention.

FIGS. 6A and 6B illustrate the bottom section 90 of the hollow paddle 138 (see FIG. 9 for assembly) of this invention 12. The bottom section 90 has a flat plate 94 with a circular wall 98 attached to its top surface 102. From the top, the flat plate 94 looks like disk with an appended tab.

Figure 7A:
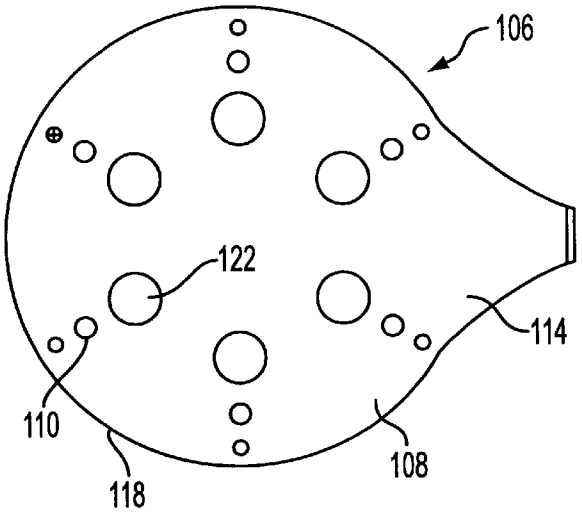
FIG. 7A is a top view of the top section of the paddle portion of this invention.
Figure 7B:
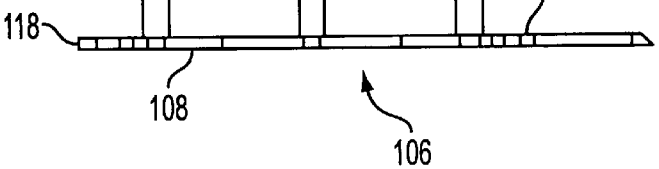
FIG. 7B is a side view of the top section of the paddle portion of this invention.

FIGS. 7A and 7B illustrate the top section 106 of the hollow paddle 138 of this invention 12. The top section has a flat plate 108 with a number of support posts 110 attached to its top surface 114, in a circular pattern, close to its periphery 18. Inward of the posts 110 are a number of holes 122 of diameter larger than that of the actuating pin 50. The bottom flat plate 94 and the top flat plate 108 are the same size and shape.

Figure 8A:
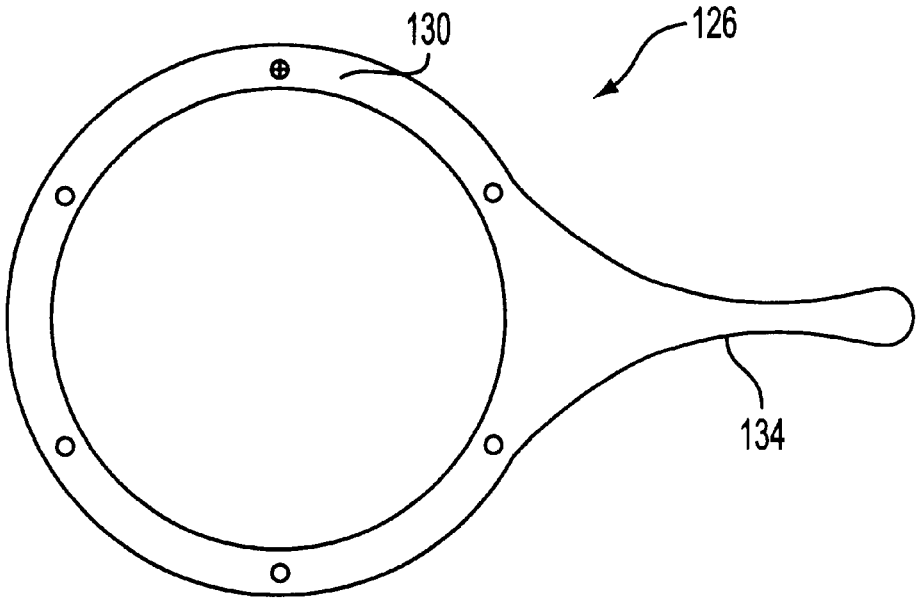
FIG. 8A is a top view of the middle section of the paddle portion of this invention.
Figure 8B:
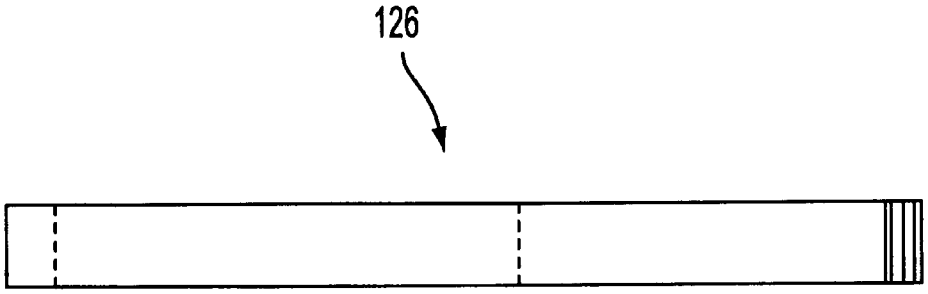
FIG. 8B is a side view of the middle section of the paddle portion of this invention.

FIGS. 8A and 8B illustrate of the middle section 126 of the hollow paddle 138 of this invention 12. The middle section 126 is essentially a circular wall 130 with an appended handle 134. When the top section 106 and bottom section 90 are fastened to the middle section 126, typically with screws, an annular race way (see FIG. 10) is formed within the hollow paddle 138. The wall 98 of the bottom section 90 and the wall 130 of the middle section 126 are the same height.

FIG. 9 is a three-dimensional view of the fully assembled invention 12. A pecking bird 74 is attached as shown to each support post 110. Each sleeve 70 is also attached to the top 1114. In this Figure, the hollow paddle 138 is shown fully assembled.

FIG. 10 illustrates how each actuating pin 50 passes through a hole 122 in the top flat plate 108. It can be seen that the head 56 of the actuating pin 50 extends part way in to the raceway 142. A ball 146 of the appropriate size and weight is introduced into the raceway 142 before the paddle section 138 is fully assembled. In this way, as the paddle section 138 is tilted by the handle 134, the ball 146 will roll around the race way 142. As the ball 146 passes under the head 56 of each actuating pin 50 the actuating pin 50 is lifted causing the bird 74 to peck. If desired, the head 56 of the actuating pin 50 can be truncated, as illustrated in FIG. 10, so that the actuating pin 50 can only be lifted as the ball rolls in one direction.

The dimensions of the various components of this invention are chosen so that: the race way 142 is only slightly wider than the diameter 148 of the ball 146, the distance 150 between the head 54 or 56 of the actuating pin 50 and the top 102 of the bottom flat plate 94 is less than the diameter 148 of the ball.

The following reference numerals are used on FIGS. 1 through 10:

10 Bird body
12 Pecking bird paddle toy
14 Cavity in bottom of bird body
18 Bottom of bird body
22 Pivot pin holes
26 Fingers
30 Bird head and neck part
34 Bird head
38 Elongated arm
42 First pivot hole in elongated arm
46 Second pivot hole in elongated arm
50 Actuating pin
54 Truss head of actuating pin
56 Alternate, truncated truss head of actuating pin
58 Shank of actuating pin
62 Clevis at end of actuating pin shank
66 Pivot pin holes through clevis at end of actuating pin shank
70 Sleeve
74 Pecking bird assembly
78 First pivot pin
82 End of elongated arm
86 Second pivot pin
90 Bottom section of hollow paddle
94 Bottom flat plate
98 Annular wall of bottom section
102 Top of bottom flat plate
106 Top section of paddle portion
108 Top flat plate
110 Support post
114 Top of top flat plate
118 Periphery of top flat plate
122 Holes through top flat plate for accommodating sleeves
126 Middle section of hollow paddle
130 Circular wall of middle section
134 Handle of middle section
138 Hollow paddle portion of invention
142 Race way
146 Ball
148 Diameter of ball
150 Distance between head of actuating pin and top of bottom flat plate The pecking bird paddle toy 12 has been described with reference to a particular embodiment. Other modifications and enhancements can be made without departing from the spirit and scope of the claims that follow.

What is claimed is:

1. A pecking bird toy comprising:

a. a hollow paddle having, a top, a bottom, a handle and an interior circular raceway;

b. a pecking bird mounted on said top; said pecking bird including a body, and a head and neck part pivotally attached to said body;

c. a mechanism, attached to said head and neck part, which imparts a pecking motion to said head and neck part; said mechanism having an actuating pin extending through said top into said raceway; said actuating pin having a pinhead; and d. a ball within said raceway; said raceway having a width slightly larger than the diameter of said ball; the distance between said pinhead and said bottom being less than the diameter of said ball;

whereby, when said hollow paddle is tilted via said handle, said ball can be caused to circulate around said raceway causing said actuating pin to be periodically lifted and immediately fall, under the influence of gravity, thus causing said head and neck part to simulate a pecking motion.

2. A pecking bird toy as described in claim 2 in which said pinhead is shaped so that said ball can lift said actuating pin from either direction.

3. A pecking bird toy as described in claim 2 in which said pinhead is shaped so that said ball can lift said actuating pin from one direction only.

4. A pecking bird toy comprising:

a. a hollow paddle having, a top plate a bottom plate, an exterior annular wall, an interior annular wall and a handle attached to said exterior annular wall; whereby a circular raceway is created between said top plate, said bottom plate, said exterior annular wall and said interior annular wall;

b. a bird body mounted on said top plate; said bird body having a cavity in its lower portion;

c. a head and neck part pivotally mounted to said bird body portion, partly within said cavity;

d. a mechanism, pivotally attached to said head and neck part, which imparts a pecking motion to said head and neck part; said mechanism having an actuating pin extending through said top surface into said raceway; said actuating pin having a pinhead; and e. a ball within said raceway; said raceway having a width slightly larger than the diameter of said ball; the distance between said pinhead and said bottom plate being less than the diameter of said ball;

whereby, when said hollow paddle is tilted via said handle, said ball can be caused to circulate around said raceway causing said actuating pin to be periodically lifted and immediately fall, under the influence of gravity, thus causing said head and neck part to simulate a pecking motion.

5. A pecking bird toy as described in claim 4 in which said pinhead is shaped so that said ball can lift said actuating pin from either direction.

6. A pecking bird toy as described in claim 5 in which said pinhead is shaped so that said ball can lift said actuating pin from one direction only.

7. A method of fabricating a pecking bird toy comprising the steps of:

a. providing a ball;

b. fabricating, an essentially circular top plate;

c. fabricating an essentially circular bottom plate of the same size as said top plate;

d. fabricating an exterior annular wall of the same diameter as said top and bottom plates;

e. fabricating an interior annular wall of the same height as said exterior annular wall but of lesser diameter; the difference in diameter between said exterior and interior annular walls being slightly greater than the diameter of said ball;

f. fabricating a handle;

g. assembling said top plate, said bottom plate, said exterior annular wall, said interior annular wall and said ball to form a hollow paddle with said ball trapped in a circular raceway formed between said top plate, said bottom plate, said exterior annular wall and said interior annular wall; the dimensions of said top plate, said bottom plate, said exterior annular wall and said interior annular wall chosen so that the width of said raceway is slightly greater than the diameter of said ball;

h. attaching said handle to said exterior annular wall;

i. fabricating a bird body portion with a cavity in its lower portion;

j. fabricating a head and neck part;

k. fabricating a mechanism which imparts a pecking motion to said head and neck part; said mechanism having a descending, actuating pin; said actuating pin having a pinhead;

l. pivotally mounting said head and neck part partially within said cavity of said bird body portion;

m. pivotally attaching said mechanism to said bird body portion;

n. pivotally attaching said mechanism to said head and neck part; and o. mounting said bird body portion on said hollow paddle portion so that said actuating pin extends through said top surface into said raceway and the distance between said pinhead and said bottom plate is less than the diameter of said ball;

whereby, when said hollow paddle is tilted via said handle, said ball can be caused to circulate around said raceway causing said actuating pin to be periodically lifted and immediately fall, under the influence of gravity, thus causing said head and neck part to simulate a pecking motion.

8. A pecking bird toy as described in claim 7 further comprising the step of shaping said pinhead so that said ball can lift said actuating pin from either direction.

9. A pecking bird toy as described in claim 7 further comprising the step of shaping said pinhead so that said ball can lift said actuating pin from one direction only.

* * * * *